United States Patent [19]

Masuda

[11] Patent Number: 4,958,733

[45] Date of Patent: Sep. 25, 1990

[54] CONTAINER FOR ACCOMMODATING STRING-LIKE ARTICLES AND TAKING OUT THE SAME

[75] Inventor: Yoshiji Masuda, Osaka, Japan

[73] Assignee: Eiwa Industry Co., Ltd., Osaka, Japan

[21] Appl. No.: 467,249

[22] Filed: Jan. 19, 1990

[30] Foreign Application Priority Data

Jan. 20, 1989 [JP] Japan ..... 1-5314

[51] Int. Cl.[5] ..... B65D 85/67

[52] U.S. Cl. ..... 206/409; 206/395; 242/171; 225/48

[58] Field of Search ..... 206/409, 395; 225/39, 225/48, 49; 242/170, 171, 172

[56] References Cited

U.S. PATENT DOCUMENTS 1,901,532 3/1933 Powell et al. ..... 206/395 X
2,015,653 10/1935 Andrews ..... 206/409 X
2,017,176 10/1935 Andrews ..... 206/395 X

FOREIGN PATENT DOCUMENTS 739709 11/1932 France ..... 206/409

*Primary Examiner*—William I. Price
*Attorney, Agent, or Firm*—Oliff & Berridge

[57] ABSTRACT

A container for accommodating and taking out a string-like article which is assembled using a sheet of some hard paper to be made by a press machine in a specified pattern. The container is formed in a preferably polygonal cylinder which has a chamber formed by the bottom plate and two cover plates provided with holes at the center portion thereof. These cover plates are formed with the flaps extended from the sides opposite each other by folding the flaps inside the cylinder and being bent normal to the sides to reach the opposite side each other and the tips of the flaps being bent upward along the sides to form a symmetrically overlapped cover plates. The upper edge of the container is provided with a slit having a cutter at the bottom thereof. The coreless roll of the string-like articles is accommodated in the chamber and the inner end of the string is taken out from the container by coming through the holes, being drawn out at the desired length, being inserted in the slit, put on the blade of the cutter and cutting it.

5 Claims, 4 Drawing Sheets

CONTAINER FOR ACCOMMODATING STRING-LIKE ARTICLES AND TAKING OUT THE SAME

BACKGROUND OF THE INVENTION

1. Field of the Invention

The present invention relates to a container which accommodates the roll of string-like articles such as string, tape, band and sheet, which are used in general for binding packages etc. and one end of the string is adapted to be drawn out continuously from the container through a hole provided therein.

2. Description of the Prior Art

Conventionally, the string-like articles such as a string etc. for use in packaging for instance has been accommodated in a container (or box) in the form of a roll and the inner end of the string roll which is formed as a coreless roll, is drawn out from the container through a hole provided on the cover of the container and cut at a desired length of the string by putting it on the blade of a cutter mounted on one part of the container.

Such a container is disclosed for instance in the Japanese Patent Laid-open No. sho 59-163158. FIG. 4 of the present application outlines such a structure as disclosed in section in the prior art. In accordance with FIG. 4, an accommodation box 5 has a square shape in section and at the bottom thereof a bottom plate 11 is provided. Numeral 3 designates a cover plate having a hole 4 at the center portion thereof, through which the string is drawn out. A slit 7 provided with a blade of a cutter at the bottom thereof is provided in the top edge of one of the walls which stand around the cover plate 3. The string 1 which is wound in a form of a roll, accommodated in the box 5 and drawn out from the hole 4 at a certain length is inserted into the slit 7 and put on the blade, so that the string having a desired length is obtained.

In this disclosure, as seen easily, the cover plate 3 has an unusual thickness, so that the hole 4 pierced therethrough has a long span which causes the string coming through the hole to have an appropriate friction so as to avoid the string from retracting back unintentionally into the hole after being cut.

Further, the cover plate 3 is made of foam polystyrene by molding and attached to the inside of the box 5 at the opening side opposite to the bottom plate 11 by adhesive in such a manner as the adhesive location is positioned so as to keep a space where the slit can be provided.

The object of the present invention is to provide an improvement of the above container by simplifying the structure thereof and reducing the manufacturing cost.

SUMMARY OF THE INVENTION

The container according to the present invention comprises a polygonal cylinder having a bottom plate which is formed by bending at least one extended portion of one side of the cylinder normal to the wall of the cylinder and abutting against the opposite side of the cylinder by inserting the end thereof in the cylinder, a first cover plate which is formed by folding flat one extended portion of one side of the cylinder of the opposite side to the bottom plate inside the cylinder and bending it normal to the side to reach the opposite side and being bent again upward along the side, and a second cover plate which is formed by carrying out the same processes to the extended portion of the opposite side to the first side, thereby the first cover plate and the second cover plate are formed symmetrically.

The flatly folded portion of the upper edge of the cylinder is kept for providing a slit thereon and in the slit a cutter is provided at the bottom thereof. And each of two cover plates is provided with a hole at the center thereof. The bottom plate and the cover plate form a chamber in which the coreless roll of the string-like articles is accommodated and the inner end of the article is drawn out through the hole and cut at the desired portion of the same by inserting in the slit and putting the same on the blade of a cutter.

As to the cover plates, the second bent cover plate is overlapped on the first cover plate, so that although the latter cover plate may receive a pulling force from the string being drawn out through the hole due to the friction between the string and the hole, the upper cover plate supports the lower cover plate.

By this improvement of the present invention, the container can be formed by assembling one sheet of hard paper having a certain pattern which is manufactured by a press machine. The container assembled has two cover plates which are formed by folding and bending in a body with the container, so that the string roll is easily accommodated in the chamber of the container by opening the bottom plate or unfolding the covers, in addition to that when it is in use, the covers function as a stopper for the roll's coming out from the chamber when the string is drawn out due to the bending resistance of the cover plates.

Further, even if the string drawn out from the hole would have been retracted inside the container by chance, it is quite easy to make the tip end of the string come through the hole by unfolding the cover plates.

DETAILED EXPLANATION OF THE PREFERRED EMBODIMENT

Figure 1:
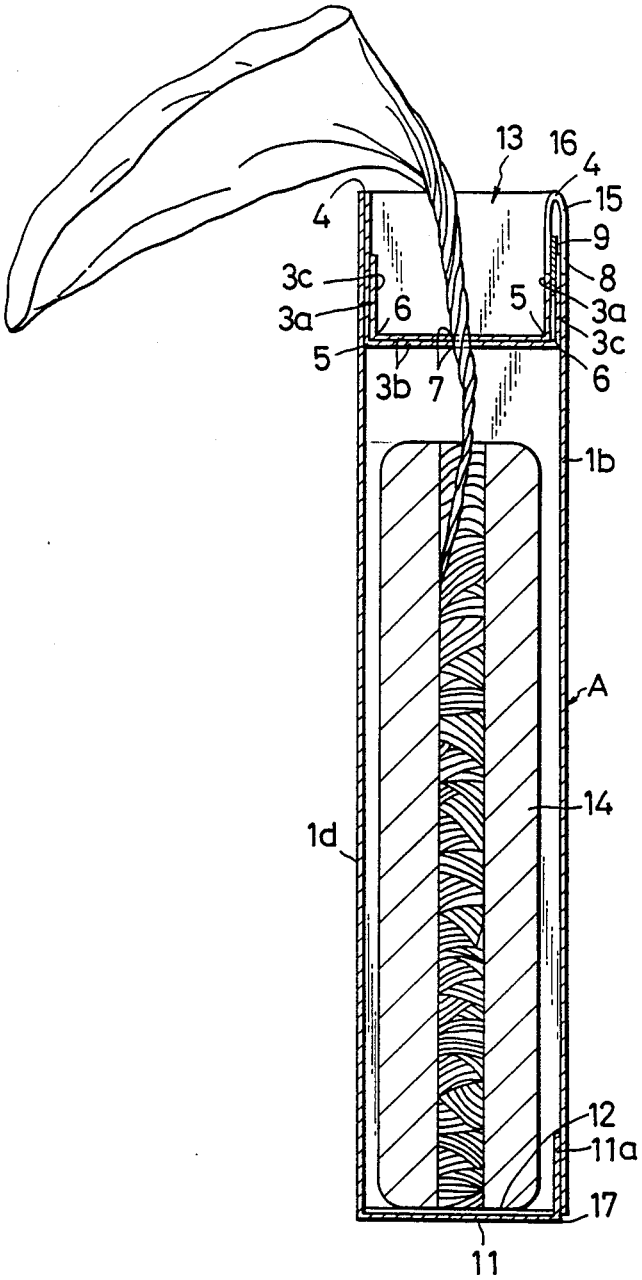
FIG. 1 is a sectional side view of the embodiment of the present invention.
Figure 2:
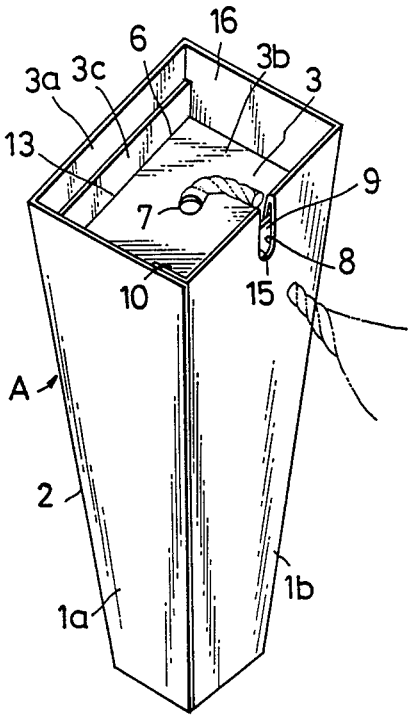
FIG. 2 is a bird's-eye view of the the embodiment of the present invention, illustrating the state of the container after the string is cut down.
Figure 3:
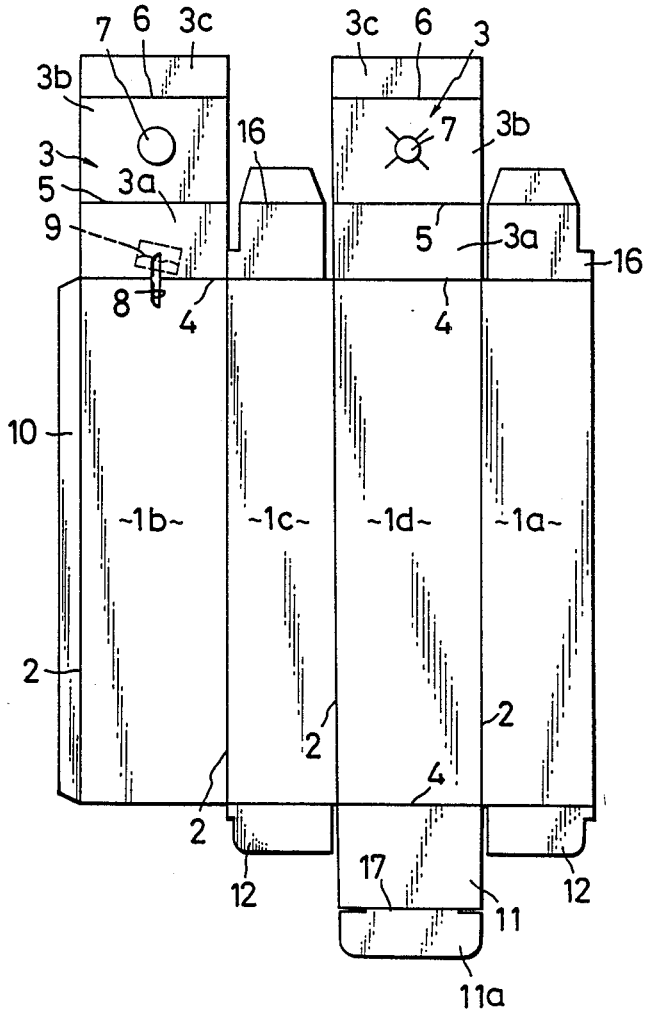
FIG. 3 is a developed view of the container before assembling it.
Figure 4:
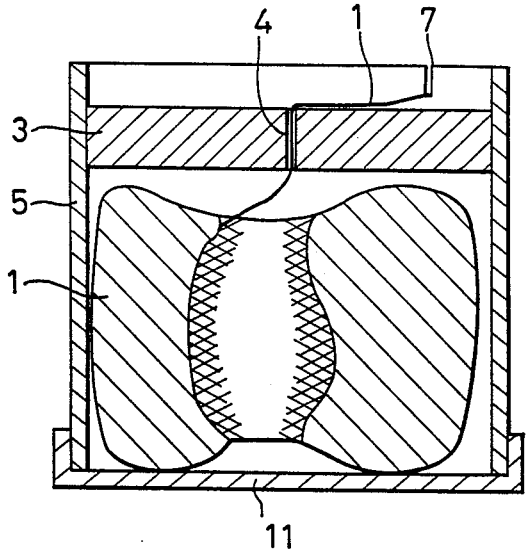
FIG. 4 Prior Art
FIG. 4 shows a sectional view of a conventional container as a prior art.

Referring to the FIGS. 1–3 illustrating one embodiment of the present invention, the container having a square shape in section is assembled from one sheet of hard paper which is manufactured by a press in a specified pattern as shown in FIG. 3, wherein the numeral 1*a*, 1*b*, 1*c* and 1*d* illustrate four sides of the container by being bent along the four folds 2 and it is formed in a square-shaped cylinder by adhering the overlap width 10 to the inside of the side 1*a*. The sides 1*a* and 1*c* have the same width and the sides 1*b* and 1*d* have the same width. The lower edge of the side 1*d* is extended to form a flap 11 as a bottom plate through a fold 4 having a folding piece 11*a* through a fold 17. On the lower edges of the sides 1*a* and 1*c* the folding pieces 12, 12 are extended through the folds 4, while the upper edges thereof are extended to form the folding pieces 16. The upper edges of the sides 1*b* and 1*d* are extended to form the flaps 3, 3, each of which is divided into three pieces 3a, 3b and 3c via folds 5 and 6 respectively. These 3b, 3b form a cover plate after assembly, at the center portion of which the holes 7, 7 for the exit of the string-like articles are located.

8 is a slit or an aperture which is provided across the fold 5 on the side 1b.

For the assembly of the above sheet into a container, the sides 1a, 1b, 1c, 1d and the overlap width are folded along the folds 2 at right angles and the overlap width 10 is adhered to the inside of the side 1a to form a square-shaped cylinder A.

Subsequently, the folding pieces 12, 12, the bottom plate 11 and the folding piece 11a are bent inside respectively at the folds 4 and the bottom plate 11 is overlapped on the folding pieces 12, 12 and the folding piece 11a is inserted into the cylinder A.

Next, the folding pieces 16, 16 are folded inside in the opening 13 (inside the cylinder) and the tip portions of the pieces 16 are bent normal to the sides 1a and 1c at the folds 5, and the one flap 3 of the side 1d is folded in the opening 13 at the fold 4 and the cover plate 3b is bent at 90 degree normal to the side 1d at the fold 5 and further the folding pieces 3c is bent upward along the side 1b. The same procedures are employed as to the other flap 3 and consequently the newly bent flap 3 is overlapped over the first flaps. Thereby, the folded aperture 8 forms a slit 15 which is provided with a cutter to be fastened thereto by an appropriate means such as adhesive.

Numeral 14 means the string-like articles, which is a tube made of the synthetic resin film such as polypropylene or polyethylene and formed as a twisted string and wound in a roll having no core.

The operation of the container and how to use it are described hereinafter.

For accommodating the string 14 in the container, the bottom plate 11 is to be opened or the flaps 3, 3 are to be opened by pulling up and unfolding those. After accommodating the roll of the string 14, the inner end of the string is come through the holes 7, 7 of the cover plates 3b which is kept half-opened. Then the flaps are reformed in the assembled form using the formed folding habit.

For making use of the string, the string which is projected out of the hole 7 is to be pulled out at the desired length and inserted in the slit 15 and put the string on the blade of the cutter 9 and pulled again to obtain the necessary length of the string 14. The space between the hole 7 and the cutter 9 functions for retaining the string projected from the hole 7. To avoid the string from being drawn too much, it is necessary to make the diameter of the hole 7 smaller than the one of the string, which causes the flaps 3, 3 to increase the tendency of being pulled up by the friction between the hole 7 and the string 14. The cover plate 3b located under the other cover plate 3b receives the pulling force harder than the upper one, however the folded portion 3a of the upper flap 3 functions as a stopper against the above pulling force. Thereby the roll of the string is not come out of the container by pulling the string. In addition, preferably the folding pieces 16 generate a friction resistance between the side edges of the flaps 3, 3 and the sides 1a and 1c.

In this embodiment, the type of providing two flaps are illustrated but the type of one flap may also be used for pursuing the same object with the present invention.

Further, the square-shaped cylinder of the above embodiment may be replaced alternatively by a cylinder type, a triangular cylinder type or a polygonal cylinder type, wherein the same formation of the flaps in accordance with the same purpose of the present invention can be made.

Still further, the location of the cutter 9 is not limited to the one illustrated but it can be provided in the form of a horizontal slit.

And the material of the container may be replaced by a plastic or any other synthetic resin.

What is claimed is:

1. A container for accommodating string-like articles and taking-out the same comprising;

a polygonal cylinder having a bottom plate which is formed by bending one extended portion of one side of the cylinder normal to the side of the cylinder and fastening the same by inserting the end thereof in the cylinder;

the first cover plate which is formed by folding flat a flap extending from the upper end of one side opposite to the bottom plate inside the cylinder, bending normal to the side to reach the opposite side and bending again upward along said side;

the second cover plate which is formed by folding flat another flap extending from the upper end of another side opposite to the first side inside the cylinder, bending normal to the side to reach the first side and bending again upward along said side;

whereby the first and the second cover plates overlap each other in such a manner as the upper cover plate avoids the lower cover plate from opening upward;

a slit provided on the upper edge of the cylinder;

a cutter mounted at the bottom of the slit; and two holes provided at the center of each cover plate, through which the string-like articles is drawn out from the roll thereof accommodated in the chamber formed by the bottom plate and the cover plate.

2. A container according to the claim 1, in which the polygonal cylinder is a squarely shaped cylinder.

3. A container according to the claim 1, in which the polygonal cylinder is a cylinder.

4. A container according to the claim 1, in which the cover plate is formed with one flap.

5. A container according to the claim 1, further including at least one auxiliary folding piece being provided on the upper edge of the side adjacent to the side having the flap, to render a friction resistance to the flap by being inserted between the side edge of the cover plate and one side of the cylinder.

* * * * *